US005451835A

United States Patent [19]

Yamazaki et al.

[11] Patent Number: 5,451,835

[45] Date of Patent: Sep. 19, 1995

[54] ELECTRON BEAM DISPLAY DEVICE AND PRODUCTION THEREOF

[75] Inventors: Fumio Yamazaki, Shijounawate; Yutaka Nishimura, Kadoma; Kinzo Nonomura, Ikoma; Yasuhisa Ishikura, Katano, all of Japan

[73] Assignee: Matsushita Electric Industrial Co., Ltd., Japan

[21] Appl. No.: 194,332

[22] Filed: Feb. 8, 1994

[30] Foreign Application Priority Data

Feb. 8, 1993 [JP] Japan ..... 5-020046
Nov. 19, 1993 [JP] Japan ..... 5-290520

[51] Int. Cl.[6] ..... H01J 29/28

[52] U.S. Cl. ..... 313/422; 313/479; 313/466

[58] Field of Search ..... 313/422, 479, 485, 489, 313/635, 463, 466

[56] References Cited

U.S. PATENT DOCUMENTS 4,975,619 12/1990 Datta et al. ..... 313/466
5,045,750 9/1991 Itou et al. ..... 313/466
5,141,461 8/1992 Nishimura et al. ..... 313/466 X

FOREIGN PATENT DOCUMENTS

0067470A1 12/1982 European Pat. Off. .
0446878A2 9/1991 European Pat. Off. .
2166164 8/1973 France .
2164174 7/1972 Germany .
3032907 4/1982 Germany .
2120840 12/1983 United Kingdom .
2159323 11/1985 United Kingdom .

*Primary Examiner*—Sandra L. O'Shea
*Assistant Examiner*—Ashok Patel
*Attorney, Agent, or Firm*—Wenderoth, Lind & Ponack

[57] ABSTRACT

An electron beam display device which has high contrast and excellent image quality, by eliminating halation due to re-collision of the electrons in the fluorescent element area. The electron beam display device includes a face glass on which an image is formed, a cathode for emitting electron beams, a fluorescent element layer on the face glass and facing the cathode, with which layer electron beams collide to emit light for forming an image on the face glass, an aluminum layer as anode on the fluorescent element layer, and a carbon layer on the aluminum layer, having a thickness sufficient to prevent electrons, reflected in the aluminum anode layer by collision of electron beams with the aluminum anode layer, from coming back into the face glass.

3 Claims, 4 Drawing Sheets

ELECTRON BEAM DISPLAY DEVICE AND PRODUCTION THEREOF

FIELD OF THE INVENTION

The present invention relates to a display device using electron beam. More particularly, the invention relates to a display device using an electron beam with high contrast ratio.

BACKGROUND OF THE INVENTION

The display device using electron beam has been hitherto used as a display device in video appliances and the like.

A conventional electron beam display device is described with reference to FIG. 1. FIG. 1 shows the principle of a flat plate type display device using electron beam. Electrodes are disposed in a vacuum container not shown in the drawing, and number 1 is a back electrode, and 2 denotes a plurality of linear cathodes which emit electron beam. Number 3 is an electron beam focusing electrode, 4 is a modulation electrode, 5 is an electron beam focusing electrode, 6 is a horizontal deflecting electrode, 7 is a vertical deflecting electrode, 8 is a face plate, and 12 is an electron beam. FIG. 7 is a detailed sectional view of the face plate. Number 9 denotes a fluorescent element and 10 is an anode composed of an aluminum layer. When the cathode 2 is heated, an electron beam is released, and passes through the electron beam controlling electrode group, and collides against the anode 10 to illuminate the fluorescent element 9, thereby forming an image (Japanese Laid-open Patents Sho. 61(1986)-124043, Hei. 2(1990)-78139).

However, when an electron beam is irradiated to the anode of the conventional flat plate type electron beam display device, part of the electron beam is reflected by the anode and come back to the cathode side. The reflected electrons are returned back by action of high electric field applied between the cathodes and anodes for accelerating electron beam, and again dived into the anode. These reflected electrons cause dim lits in the surrounding area of the electron beam irradiation point, which is called "halation". In particular, when the anode voltage is raised, the energy of the reflected electron is increased, and this phenomenon becomes more serious. This phenomenon was a serious problem for image performance because the image contrast is lowered and the sharpness is sacrificed.

In order to reduce the halation, it has been proposed that a shadow mask is disposed in front of the anode electrode to trap electrons reflected from the surface of the anode electrode layer, thus preventing returning the electrons back into the anode electrode layer. However, the formation of the shadow mask makes the structure complicated and makes the process for producing the display device complicated.

It is also proposed that carbon particles or graphite particles dispersing a binder over the aluminum layer are applied by coating means of spray method, printing method or the like (see FIG. 8). The carbon particle layer 11 suppresses the reflection of electrons. The carbon particle layer, however, has not been studied yet in details and therefore excellent technical effects have not been obtained.

SUMMARY OF THE INVENTION

It is hence a primary object of the invention to provide a display device of high contrast and excellent image quality, by eliminating halation due to re-collision of the electrons in the fluorescent element area of the display device using an electron beam in order to solve the conventional problems.

The present invention provides an electron beam display device comprising

- a face glass on which an image is formed,
- a cathode for emitting electron beams,
- a fluorescent element layer present on the face glass with facing the cathode, to which electron beam is collided to emit light for forming an image on the face glass,
- an aluminum layer as anode, present on said fluorescent element layer, and
- a carbon layer present on the aluminum layer, having such a thickness sufficient to prevent returning electrons reflected in the aluminum anode layer by collision of electron beam with the aluminum anode layer back into the face glass.

DETAILED DESCRIPTION OF THE INVENTION

The electron beam display device of the present invention do not have a shadow mask to trap electrons reflected on the anode layer. In the present invention, the carbon layer having a specific thickness is formed on the aluminum anode layer. This carbon layer effectively prevents returning electrons reflected in the aluminum anode layer back into the aluminum anode layer.

A coating amount of the graphite particles can be expressed by graphite weight per unit area ($\mu g/cm^2$) and preferably is within the range of 20 to 220 $\mu g/cm^2$, more preferably 20 to 150 $\mu g/cm^2$, most preferably 30 to 120 $\mu g/cm^2$. If the coating amount is less than 20 $\mu g/cm^2$, the preventing effects of halation are reduced. If it is more than 220 $\mu g/cm^2$, transmittance of the electron beam is deteriorated.

It is further preferable that a thickness of the carbon layer should be more than the thickness of the aluminum anode layer.

The carbon layer can be prepared from carbon particles or graphite particles, but preferably prepared from plate-like graphite particles if the graphite particles have plate shape, they are coated on the aluminum anode layer closely packed with little space, which does not deteriorate transmittance of the electron beam and which effectively prevent returning the reflected electrons (or back scattered electrons) back into the aluminum anode. The plate-like graphite particles preferably have a plate ratio (a ratio of longest diameter / shortest diameter) of at least 10/1, more preferably 15 / 1. It is also preferred that the graphite particles have an average particle size of not more than 2 $\mu m$, more preferably not more than 1.5 $\mu m$; the average particle size being calculated in terms of spherical particles.

The carbon layer may be formed by any methods known to the art, for example evaporation method, sputtering method, printing method, coating method or a combination of printing method and transferring method. If plate-like graphite particles are employed, it is preferred that they are printed on a suitable substrate and then transferred onto the aluminum layer 20. This printing and transferring combination method effectively reduces stress which occurs in a large-area carbon layer formed by spattering and evaporating methods.

The fluorescent element layer may be in a stripe form and be alternately disposed with a black substance layer. Gas vent holes may be preferably formed in the carbon layer, and preferably the gas vent holes should be formed corresponding to the black substance layer among the fluorescent materials.

A process for producing the electron beam display device of the invention comprises the steps of laminating a fluorescent element, an aluminum layer, and a carbon layer on the inner surface of a face glass in this order, and the carbon layer being formed by evaporating or sputtering method.

The aluminum anode layer may have a rough surface on the fluorescent element layer. The aluminum anode layer having rough surface may preferably be prepared by preliminary forming an aluminum layer on a substrate film by any method, rubbing the free surface to form roughness on the surface, and then transferring the aluminum layer on the fluorescent element layer with facing the rough surface to the fluorescent element layer.

PREFERRED EMBODIMENT OF THE INVENTION

Figure 1:
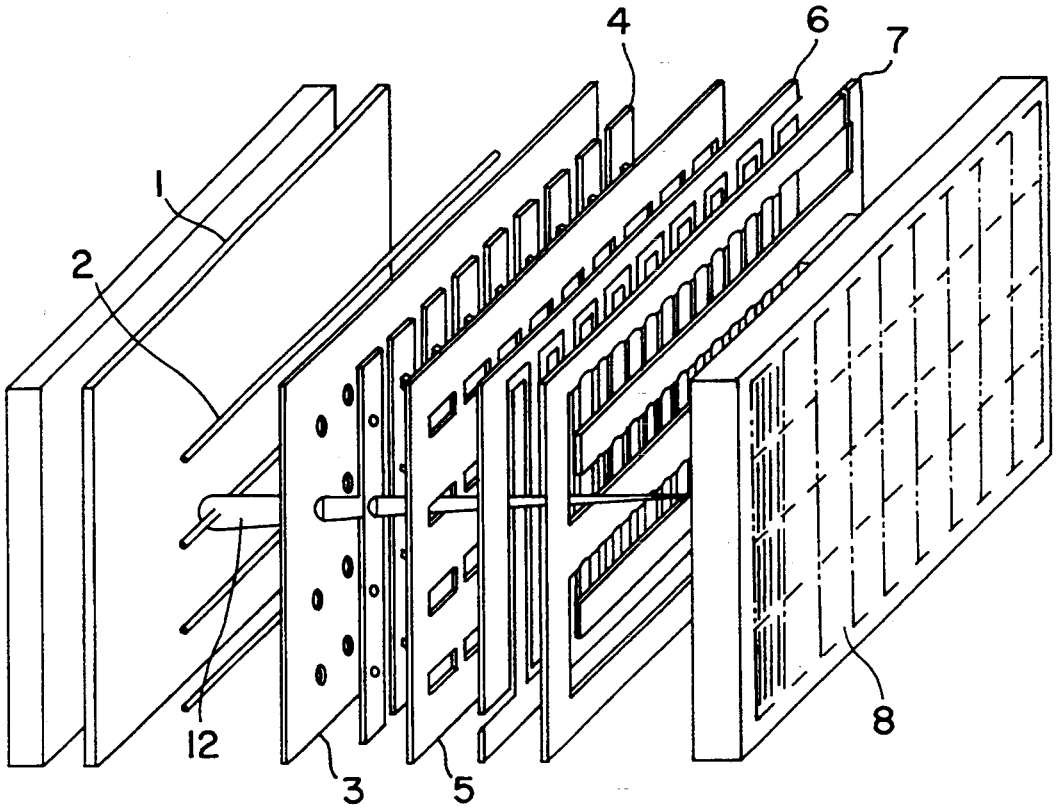
FIG. 1 (PRIOR ART)
FIG. 1 is a perspective sectional view of a conventional display device.

Referring now to the drawings, some of the embodiments of the invention are described in detail below.

FIG. 1 shows the principle of a flat plate type display device using electron beams. Electrodes are disposed in a vacuum container not shown in the drawing, and element 1 is a back electrode, and 2 denotes a plurality of linear cathodes. Element 3 is an electron beam focusing electrode, 4 is a modulation electrode, 5 is an electron beam focusing electrode, 6 is a horizontal deflecting electrode, 7 is a vertical deflecting electrode, 8 is a face plate, and 12 is an electron beam.

Figure 2:
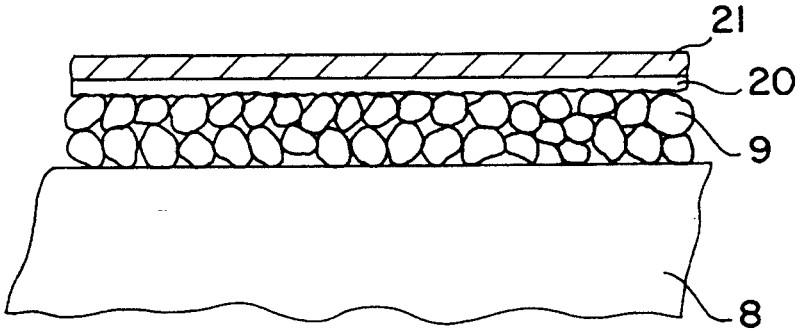
FIG. 2 is a magnified sectional view of a fluorescent element part in the embodiment of the invention.
Figure 3:
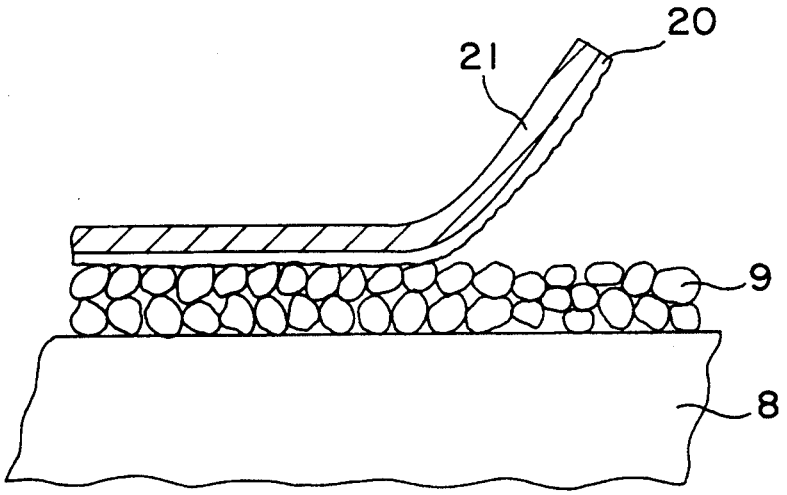
FIG. 3 is a process chart of aluminum transfer in the embodiment of the invention.
Figure 4:
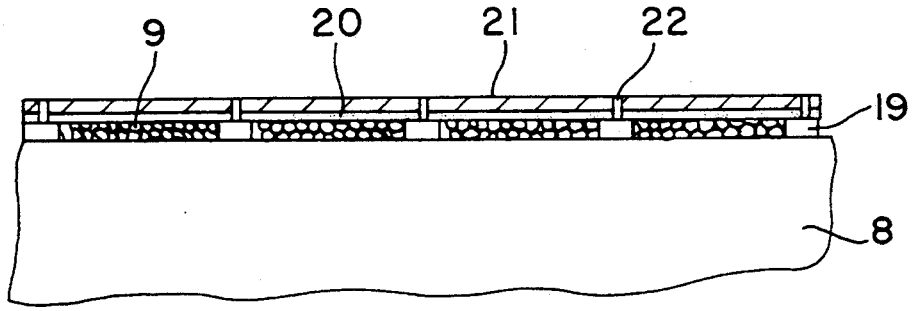
FIG. 4 is a sectional structural diagram of gas vent holes of a fluorescent element in other embodiment of the invention.

FIG. 2 is a detailed drawing showing a sectional laminate structure of the face plate. Element 9 is a fluorescent element layer, prepared from fluorescent particles having a particle size of about 5 $\mu$m, which generally has a thickness of about two fluorescent particles. The fluorescent element is formed in a stripe of R, G and B colors with an intermediate black layer 19 as shown in FIG. 4. Element 20 denotes an anode composed of an aluminum layer having a thickness of about 2,000 angstroms. The aluminum anode layer 20 has a roughness of about 500 angstroms on the side of the fluorescent element. As shown in FIG. 3, the aluminum anode layer 20 is formed by preliminary forming an aluminum layer on a substrate, forming roughness by rubbing and the like on the free surface, and then transferring it on to the fluorescent element layer 9 from the substrate. Element 21 is a carbon layer, which is formed by evaporating or sputtering method. The layer thickness can be from about 3,000 angstroms to about 10,000 angstroms, but is not limited thereto, and an optimum layer thickness is set depending on the degree of acceleration voltage and back scattering of electron beam. By increasing the thickness of aluminum layer, the reflected electrons from the fluorescent element particles are decreased, but the transmission of electron beams is also decreased, which gives rise to another problem of lowering of brightness. Accordingly, by increasing the thickness of the carbon layer which has relatively high transmittance, reflection when electron beam is collided with the carbon layer is decreased, and reflected electrons from the fluorescent element particles can be decreased at the same time. Moreover, by forming fine roughness on the aluminum layer surface 20 of the fluorescent element side, the reflected (scattering) beam from the fluorescent element can be again scattered by the rough surface of the aluminum layer 20 to suppress re-collision into the aluminum layer 20, thereby substantially decreasing the electron beams returning reversely through the aluminum layer 20.

As shown in FIG. 4, tiny holes 22 may be formed in the aluminum layer 20 and carbon layer 21 at positions corresponding to the black layers 19 of the fluorescent element part. As a result, swelling of the aluminum layer 20 due to gas when baking the fluorescent element can be prevented. Formation of gas vent holes 22 on the black layers 19 is effective for avoiding the problem of reflected electron beam from the fluorescent element particles.

According to the display device of the present invention, the electron beam emitted by heating and releasing the cathode 2 passes through the electron beam control electrode group, and impinges against the anode 20 to illuminate the fluorescent element 9 to form an image, but the back scattered (reflected) electrons of the fluorescent element part is substantially decreased, thereby realizing a display device of excellent image quality free from image deterioration due to halation.

Figure 5:
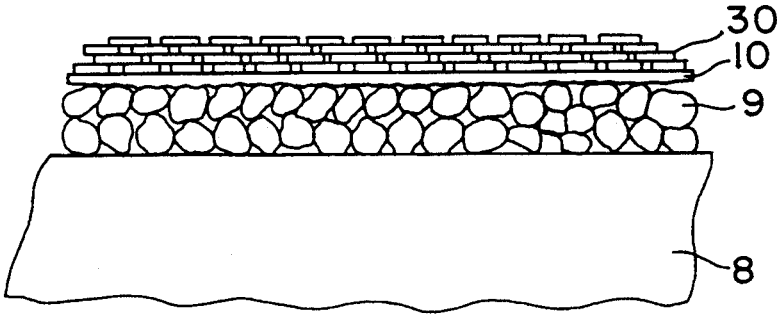
FIG. 5 is a magnified sectional view of the fluorescent element part in the other embodiment of the invention.

FIG. 5 shows an embodiment of the second embodiment of the invention. In FIG. 5, number 8 denotes a face plate, 9 is a fluorescent element layer, 10 is an aluminum layer, and 30 is a carbon layer formed from plate-like graphite particles.

Table 1 shows the unevenness of thickness of carbon atom layer and degree of halation by varying the plate ratio and particle size of graphite particles used in the carbon atom layer of the embodiment. The adhesion strength of graphite particle layer is also shown in the table. As is understood from the table, graphite particles having a low plate ratio are generally large in particle size, and the unevenness of thickness of carbon atom layer tends to be greater. In particles lower in plate ratio and smaller in particle size, relatively excellent properties are shown. However, in such graphite particle layer, the graphite adhesion strength is weak, and a problem in reliability may be caused. Comprehensively judging from the table, as the graphite particles to be used in the carbon atom layer, fine graphite particles having a plate ratio of 1:10 or more and a particle size (calculated in terms of spherical particle) of 2 μm or less are found to be preferred.

TABLE 1

| | Graphite plate ratio | Mean particle size (μm) | Degree of thickness unevenness | Degree of halation | Adhesion strength of graphite particles |
|---|---|---|---|---|---|
| Example 1 | 1:15 | 1.5 | Small | Small | Strong |
| Example 2 | 1:20 | 1.2 | Small | Small | Strong |
| Example 3 | 1:30 | 1.0 | Small | Small | Fairly strong |
| Example 4 | 1:35 | 0.5 | Small | Small | Very strong |
| Example 5 | 1:5 | 3.0 | Large | Large | Weak |
| Example 6 | 1:8 | 2.5 | Large | Large | Weak |
| Example 7 | 1:15 | 2.5 | Medium | Medium | Medium |
| Example 8 | 1:8 | 1.5 | Small | Small | Weak |

Figure 6:
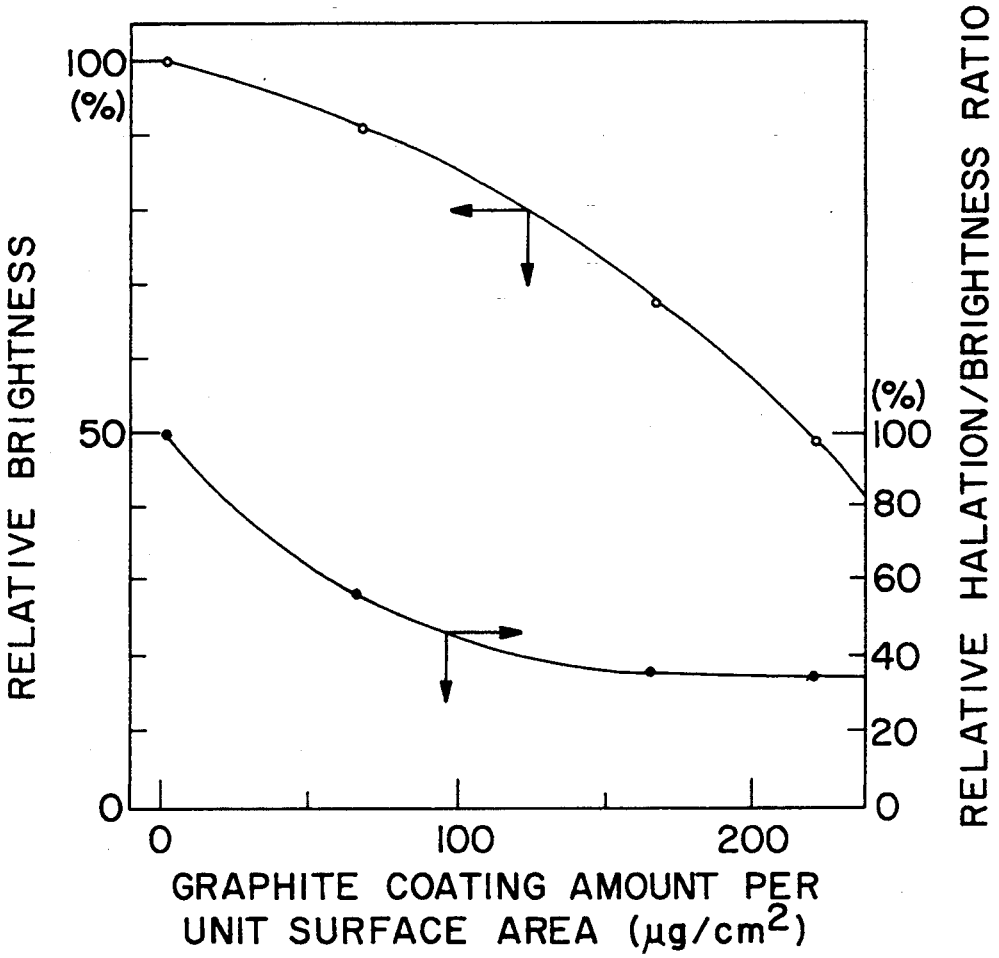
FIG. 6 is a relative diagram of graphite particle layer and relative brightness.
Figure 7:
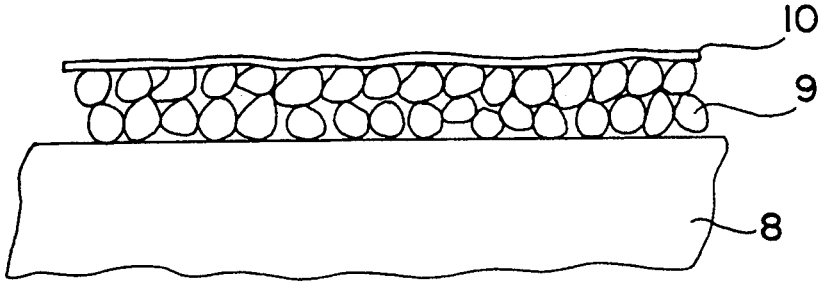
FIG. 7 (PRIOR ART)
FIG. 7 is a magnified sectional view of a conventional fluorescent element part.
Figure 8:
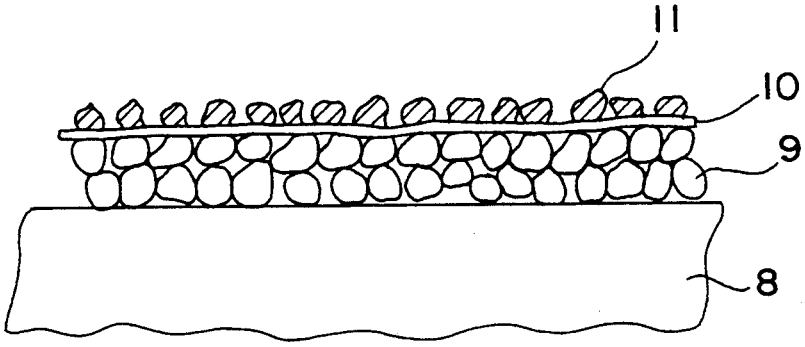
FIG. 8 (PRIOR ART)
FIG. 8 is another magnified sectional view of a conventional fluorescent element part.

FIG. 6 shows the display brightness and halation by varying the amount of graphite particles to be laminated on the carbon atom layer in the embodiment. When the amount of graphite particles is less than 20 $\mu g/cm^2$ per unit surface area, halation suppression effect is hardly recognized. If exceeding 220 $\mu g/cm^2$ per unit surface area, to the contrary, the display brightness is extremely lowered. To satisfy the two contradictory properties of brightness and halation, hence, it is required to define the graphite content in a range of 20 to 220 $\mu g/cm^2$.

As described herein, according to the invention, by eliminating halation due to re-collision of back scattered (reflected) electrons in the fluorescent element part of the display device using electron beams, a display device of high contrast and excellent image quality may be achieved.

What is claimed is:

1. An electron beam display comprising:

a face glass on which an image is formed;

a cathode for emitting electron beams:

a fluorescent element layer present on said face glass and facing said cathode, with which layer electron beams collide to emit light for forming an image on said face glass;

an aluminum layer as anode, present on said fluorescent element layer; and a carbon layer present on said aluminum layer, having a thickness sufficient to prevent electrons, reflected in said aluminum anode layer by collision of electron beams with the aluminum anode layer, from coming back into said face glass, said carbon layer being prepared from plate shape graphite particles.

2. The electron beam display device according to claim 1 wherein said graphite particles have a a ratio of longest diameter / shortest diameter of at least 10/1.

3. The electron beam display device according to claim 1 wherein said graphite particles have an average particle size of less than 2 μm; the average particle size being calculated in terms of spherical particles.

* * * * *